US006328356B1

(12) United States Patent
Aichmann

(10) Patent No.: US 6,328,356 B1
(45) Date of Patent: Dec. 11, 2001

(54) PULL-THROUGH LEAD SECURITY SEAL

(75) Inventor: Ortwin Aichmann, Hörbranz (AT)

(73) Assignee: Stoba AG, Horn (CH)

( * ) Notice: Subject to any disclaimer, the term of this patent is extended or adjusted under 35 U.S.C. 154(b) by 0 days.

(21) Appl. No.: 09/509,947

(22) PCT Filed: Oct. 5, 1998

(86) PCT No.: PCT/CH98/00427

§ 371 Date: Jun. 16, 2000

§ 102(e) Date: Jun. 16, 2000

(87) PCT Pub. No.: WO99/18558

PCT Pub. Date: Apr. 15, 1999

(30) Foreign Application Priority Data

Oct. 4, 1997 (EP) ..... 97117225

(51) Int. Cl.[7] ..... B65D 55/06

(52) U.S. Cl. ..... 292/318; 292/307 R; 292/322; 24/30.5 P; 24/704.1

(58) Field of Search ..... 24/16 R, 16 PB, 24/30.5 P, 17 AP, 704.1; 292/307 R, 320, 321, 322, 307 A, 319, 318

(56) References Cited

U.S. PATENT DOCUMENTS 5,364,141 * 11/1994 King ..... 292/318
5,636,412 * 6/1997 Lodi et al. ..... 292/318 X

FOREIGN PATENT DOCUMENTS

| | | |
|---|---|---|
| 2 342 681 | 3/1974 | (DE) . |
| 24 58 943 A1 | 12/1975 | (DE) . |
| 0 073 633 A1 | 3/1983 | (EP) . |
| 0 398 562 A1 | 11/1990 | (EP) . |
| 2 106 840 A | 4/1983 | (GB) . |
| 95/27968 | 10/1995 | (WO) . |

* cited by examiner

*Primary Examiner*—Teri Pham Luu
(74) *Attorney, Agent, or Firm*—Crowell & Moring, LLP

(57) ABSTRACT

A pull-through lead security seal has a base body and a tongue protruding out of the base body. The tongue can be inserted through a pull-through opening located in a housing part which is connected to the base body. A retaining insert is also located in the housing part. A predetermined breaking point, in the form of a preferably continuous groove, is situated between the retaining insert and the base body or the housing part. In the event of an attempt to tamper with the lead seal, that is, if somebody attempts to open the closed lead seal by pulling on the tongue, this predetermined breaking point breaks, detaching the retaining insert in the housing part so that it moves freely within the walls. A tampering attempt of this type can therefore be detected by a simple, superficial check.

20 Claims, 3 Drawing Sheets

PULL-THROUGH LEAD SECURITY SEAL

BACKGROUND AND SUMMARY OF THE INVENTION

The present invention relates to a particular security seal.

Security seals in which a band or a strip provided with latching means is pushed through a receiving opening located on the end of a band or strip and prevented from sliding out by retaining means mounted in the receiving opening are known for example from WO 95/27968. There, a seal is shown that has a flat basic body with a push-through opening aligned perpendicularly to the surface. A wrapping body in the form of a flat tongue or tab is formed directly on the basic body perpendicularly to the push-through direction and pointing away. The end of this tongue can be introduced in one direction into the push-through opening and pushed through. A loop is formed whose size, in other words whose diameter, can be influenced by the size of the push-through length. With increasing push-through length this loop becomes smaller. Since the retaining means in the push-through opening prevents the tongue from being pulled back, the tongue must be separated to open the loop. For this purpose, a tear-off area is provided on the tongue in this publication; this area is provided by two grooves that run transversely through the surface of the tongue and serve as tear-off grooves. In this tear-off area an outwardly projecting gripping tab is formed on which the tear-off area for tearing off can be kept. In order to make an attempt to manipulate the seal more difficult, provision is made such that the retaining means are inserted into an appropriately designed housing on the seal transversely to the push-through direction of the tongue. This is intended to prevent the retaining means which usually is accommodated in an opening in the housing in the push-through direction from being simply ripped out and then replaced.

This solution has the disadvantage that the design of the housing is relatively complicated and the insertion of the retaining means, especially in mass production, involves additional cost. If a smooth tongue is used, instead of the tongue shown and provided with retaining elements, this tongue will break under tensile stress at the same point as described below and the same disadvantages will occur.

Similar seals are also known from EP-A-0 398 562, EP-A-0 073 633, and GB-2 106 840. These seals all have in common one or more grooves designed as rip-open tabs which, when ripped open, each open the lock of the seal completely and are not intended as manipulation indications but as opening means.

In addition, pull-through security seals are also known in which the tongue has a rectangular or dumbbell-shaped cross section. Tongues of this kind can be pulled through to any position through the push-through opening, in other words the diameter of the loop formed by the seal can be adjusted continuously in contrast to the solutions with latching means in the form of notches, for example. The disadvantage of these solutions is that the tongue always breaks at the same place under tensile stress, namely at the location of the retaining means of the push-through opening since it is at that point that the cross section of the tongue is weakened by these means, conventionally knifelike means, engaging the tongue. This means that such seals are simple to manipulate. If they are ripped open they can be closed again simply after opening with the torn-off end of the tongue being inserted once again in the push-through opening and the other end of the torn-off tongue part being introduced from the other side into the push-through opening again. By introducing the end of the tongue into the push-through opening, the original tearing force of the seal closure is restored so that this manipulation can withstand a superficial examination at any time.

The goal of the present invention is to find a pull-through security seal that can be adjusted continuously in this manner and which has a high level of security against manipulation.

This goal is achieved according to the invention with a pull-through security seal with certain features reflected in the claims.

The specified breaking location between the body of the seal and the retaining element advantageously means that the closed seal, when a manipulation attempt is made, does not break at the tongue in the push-through opening but only at the specified breaking location which makes it impossible to conceal the manipulation attempt. The specified breaking location cannot be restored quickly and simply after it has been torn apart. In addition, even after the specified breaking location breaks, the seal is still closed and must now be deliberately broken apart and thus destroyed.

Preferably, a clear marking is applied over the specified breaking location. Such a marking makes it possible to check advantageously quickly whether a manipulation attempt on the closed seal has been made. This makes it impossible to replace the tongue part and retaining part with new intact parts and thus conceal the manipulation. In simple fashion, it can then be determined optically whether such a manipulation attempt or actual manipulations have been made.

An embodiment of the security seal according to the invention will now be described in greater detail with reference to the figures in the attached drawings.

DESCRIPTION OF THE PREFERRED EMBODIMENTS

Figure 1:
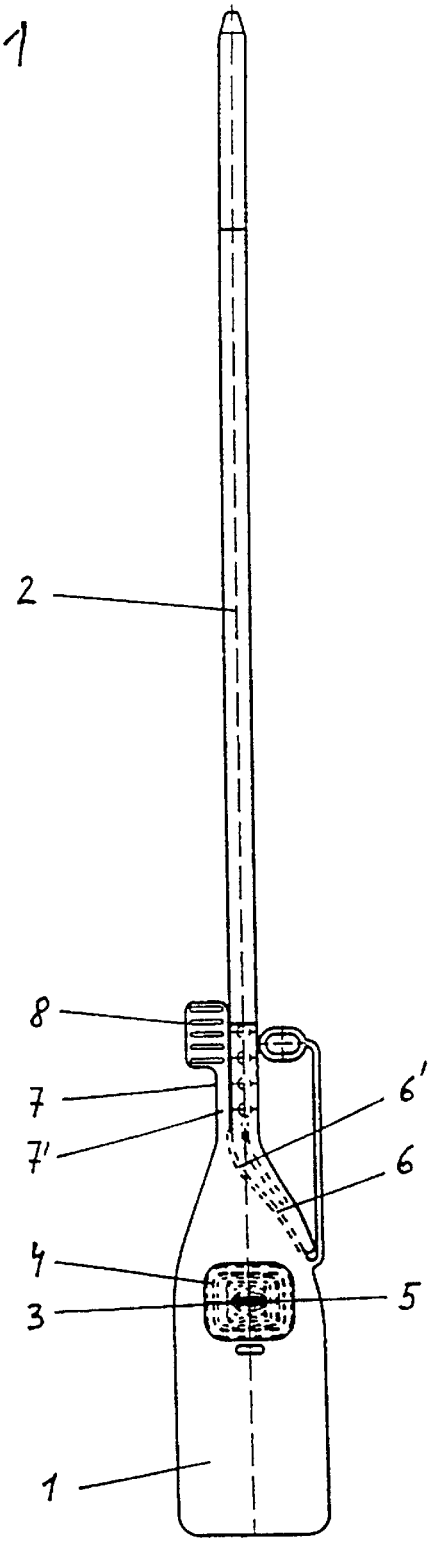
FIG. 1 is a top view of a seal according to the invention.

FIG. 1 shows a top view of a pull-through security seal according to the invention with a basic body 1, a tongue 2 projecting therefrom, and a housing part 3 that has a pull-through opening. In housing part 3 a retaining insert 4 is located, in this case in the form of a metal insert 5 inserted in a housing with a point bent outward at an acute angle in the pull-through direction. It is therefore possible that the end of tongue 2 can be inserted and pushed through into pull-through opening 3 in the pull-through direction. The points of metal insert 5 are spread apart flexibly. If an attempt is made to pull tongue 2 backward, the points of the metal insert 5 engage the surface of tongue 2 at an acute angle and prevent movement opposite the pull-through direction. In this way, it is only possible to move tongue 2 in the pull-through direction and thus to make smaller the loop formed by tongue 2 and basic body 1. This reduction can take place continuously however since the retaining insert 4 cannot engage beads at certain intervals but can engage the smooth surface of tongue 2 in any position.

The cross section of tongue 2 which is preferably rectangular or even dumbbell-shaped can simply be adjusted to the required load of the loop formed by the closed seal. With a heavy load the cross section can be made greater, in other words wider in particular, and with a smaller load it can be made more narrow. The production of such a tongue 2 that has a smooth surface is simpler than the production of tongues 2 with beads, which conventionally frequently have a circular cross sectional surface.

Figure 3:
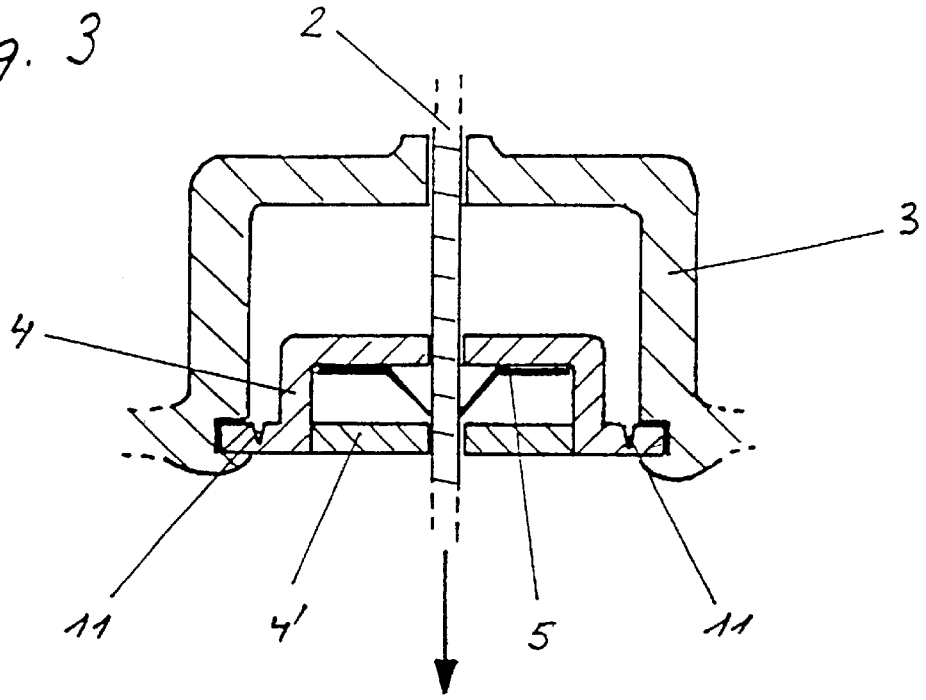
FIG. 3 is a cross section through the retaining area of the seal in FIG. 1 with the tongue inserted.

According to the invention, a tear-open tab 11 is located between retaining insert 4 and basic body 1 or housing part 3, as indicated by the cross section in FIG. 3. This tear-open tab 11 in this case is preferably designed as a specified breaking location that surrounds retaining insert 4 completely. Preferably, tear-open tab 4 is designed with the opening against the interior of housing part 3. Tongue 2 can be pulled in the pull-through direction (arrow) through the housing part with the tip of the metal insert 5 flexing and the force required being less than would be necessary for breaking open tear-open tab 11. Tongue 2 is pulled through considerably until the loop formed by tongue 2 and basic body 1 is firmly applied against the container to be sealed. As a result, pulling the tab further through in this direction is prevented and the development of a high tensile force that exceeds the breaking load of tear-open tab 11 is avoided.

Figure 4:
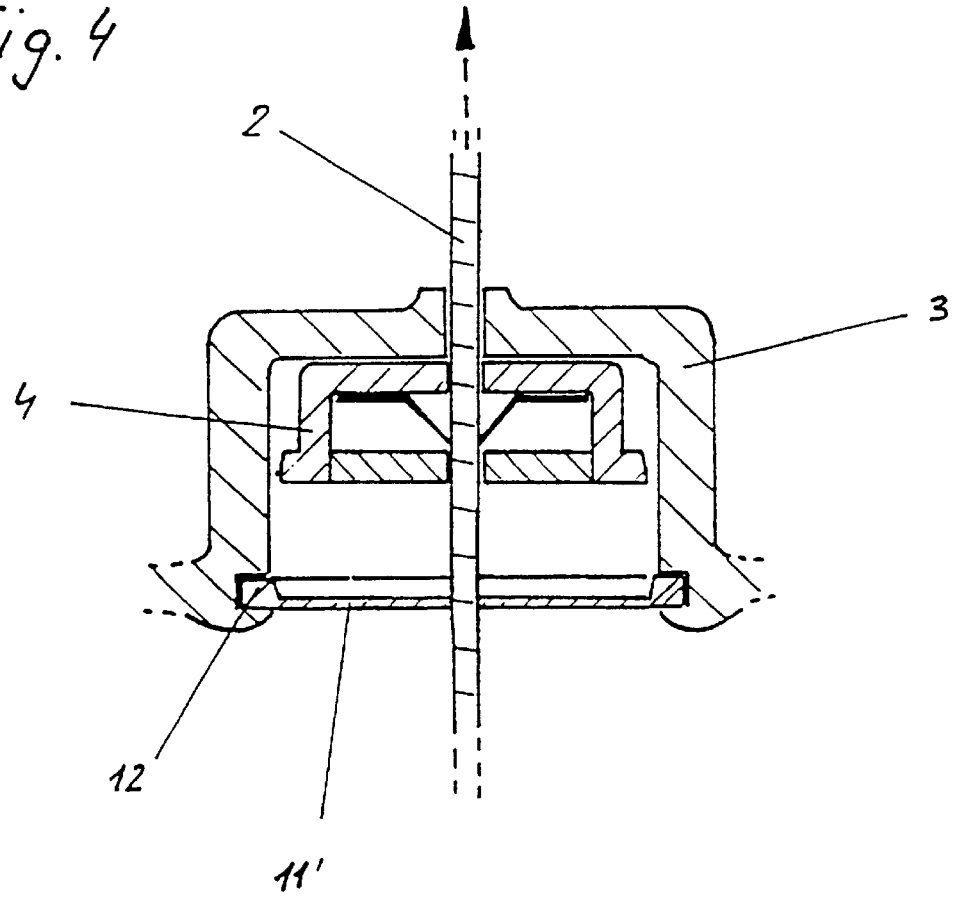
FIG. 4 is a cross section as in FIG. 3 following a manipulation in which the specified breaking location has been activated.

If an attempt is now made to expand this loop to open the container, a tensile force must be applied opposite to the pull-through direction as indicated by the dashed lines in the cross section in FIG. 4. If this force is increased, the breaking load of tear-open tab 11 is reached so that it tears and the retaining insert 4 strikes the upper end of housing part 3. Although the noose is not yet open, but retaining insert 4 is now movable in housing part 3 between the upper housing wall and the remaining edge part 12 of retaining insert 4. This can be determined simply and quickly by a quick check of the seal. An attempt at manipulation can also be determined in this way.

It is clear that such a retaining insert 4 with groove 11 is also suitable, for example for tongues 2 or seals provided with bumps and is not limited to seals with a smooth tongue surface.

Now, if after the groove 11 is torn open, the retaining insert 4 is removed completely and the seal is opened, to close it again the tongue 2 must be completely separated and a new tongue 2 and a new retaining insert 4 must be used to conceal the manipulation. Tongue 2 must be welded again to basic body 1 and retaining insert 4 must be inserted into housing 3 and connected therewith. This represents a considerable expense and can only be accomplished at all with good equipment.

Figure 5:
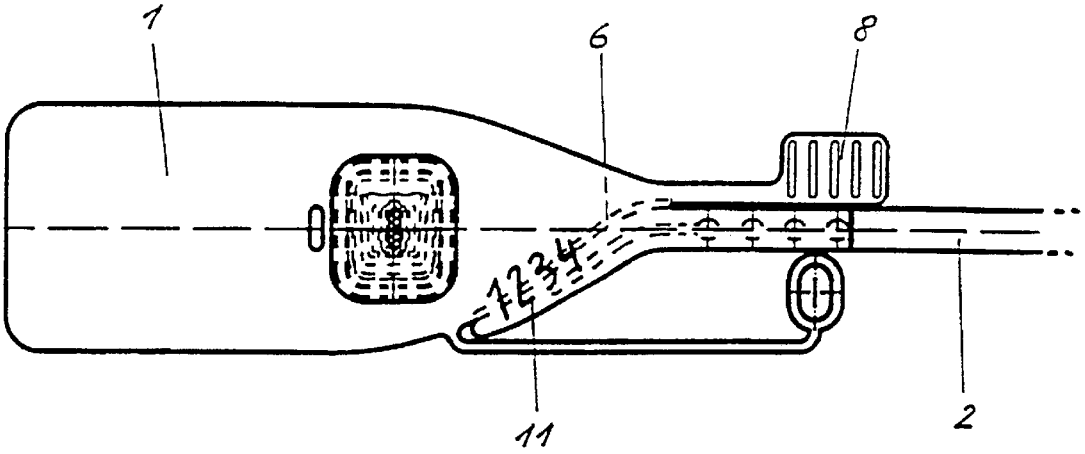
FIG. 5 is a detailed area of the seal at the transition between the basic body and the tongue with additional marking elements.

In order to detect such concealment of a manipulation that has taken place, it is also preferably proposed to apply a clear marking 11 over the area of the tear-open tab of the seal as shown in the top view in FIG. 5. This mark is applied preferably so that it extends over the tear-open tab 6. This mark 11 can consist for example of clear numbers or characters applied in depth. This makes it possible to check whether in a seal separated by the tear-open tab 6 the basic body 1 and the tongue 2 actually match or whether the original tongue 2 was replaced by another tongue 2. This would be a clear indication that a manipulation was performed on the seal.

Between basic body 1 and tongue 2 another tear-open tab is preferably also provided. It serves as an aid in removal. This tear-open tab 6 can be designed for example as a V-shaped groove and produces a reduction of the cross section in this area. This tear-open tab 6 is located essentially at an acute angle to the lengthwise axis of tongue 2, as is clearly evident from FIG. 1. It also has a curve before the transition to tongue 2 and then runs essentially in a straight and parallel line to the edge of basic body 1 or the extension of tongue 2.

In order to be able to reopen a closed seal using tear-open tab 6, in other words to separate it, provision is preferably made to mount a gripping tab 7 on basic body 1 of the seal. This gripping tab 7 has a narrow strip 7' that runs essentially parallel to tongue 2 and an expanded gripping area 8 at the end which is preferably made ribbed. This gripping surface 8 can be gripped especially well and as a result of the preferred embodiment of tear-open tab 6, it can simply be torn open by pulling on this gripping surface 8 to open the seal. Advantageously, the torn-open seal remains in one piece and an additional separate tear-off part is not produced as is the case in known pull-through security seals with tear-open strips in which the tear-open strips are provided on both sides with tear-open tab.

Figure 2:
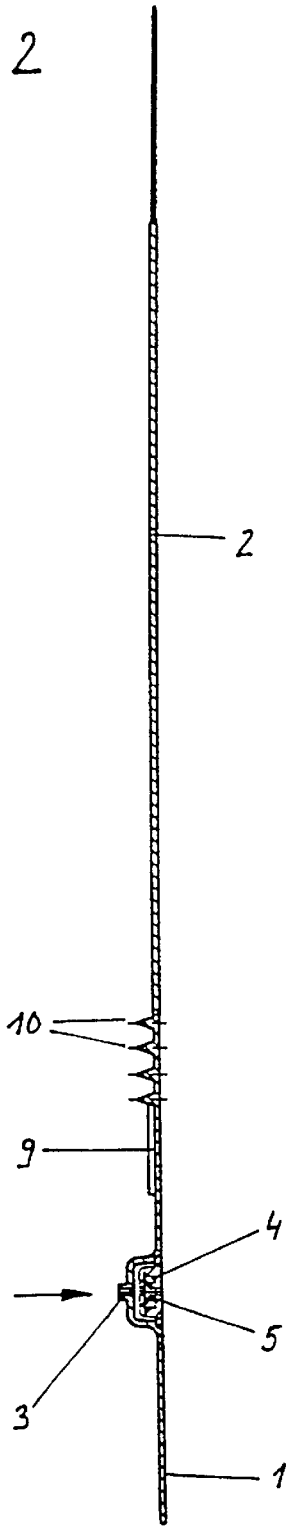
FIG. 2 is a lengthwise section through the seal in FIG. 1.

In FIG. 2, the seal in FIG. 1 is shown in a side view. Here, it is also evident that tongue 2 has a reinforcing rib 9 preferably in the vicinity of tear-open tab 6. This stiffening rib 9 serves to improve the tear-open behavior in the vicinity of tear-open tab 6. In addition, it is clear that tongue 2 on its side facing the loop to be formed, has retaining cams 10 shaped to form points. These serve to connect the seal loop permanently with the object to be sealed.

Another advantage in the design according to the invention for a pull-through security seal is that after the tear-open tab has been torn open, the free tongue end of tongue 2 of the tear-open tab 6 has essentially the same cross section over its entire length. This is especially advantageous when the tongue is pushed through the eyes of a container to be sealed and now can simply be removed by pulling it through these eyes again. In conventional pull-through security seals, this tongue area has a larger cross section or a greater width than the rest of the tongue because of the conventional arrangement of the tear-open strip. As a result, the tongue cannot simply be pulled back through the eyes but this area must first be separated separately, for example by a cutting device. If such containers are sealed with a pull-through security seal according to the invention, they can be opened simply by tearing them open at the tear-open strip and advantageously removed from the container without additional work steps or gripping the container.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Pull-through security seal comprising:

a basic body and a tongue projecting therefrom, and a housing part located on said basic body and having a pull-through opening, with retaining means for said tongue, wherein, in the vicinity of a transition between the housing part and the retaining means, a groove is designed as a specified breaking location in such fashion that when a tensile stress appears between said retaining means and said tongue, this specified breaking location is the first to breaks with the housing part fitting around said retaining means in such fashion that, after said groove breaks, said retaining means strikes the wall of said housing part in the direction of the pull-through opening.

2. Pull-through security seal according to claim 1 wherein the groove has an opening which is located so that it points into the interior of said housing part.

3. Pull-through security seal according to claim 2 wherein, in the vicinity of the transition between the basic body and the tongue, a single notch is designed as a tear-open strip which runs at an acute angle to the lengthwise axis of the tongue and has a curved area.

4. Pull-through seal according to claim 3 wherein said tongue has a reinforcing rib in the vicinity of said notch.

5. Pull-through security seal according to claim 2 wherein a retaining tab is formed on said basic body that extends essentially parallel to the tongue and has a ribbed area at its end.

6. Pull-through security seal according to claim 1 wherein a retaining tab is formed on said basic body that extends essentially parallel to the tongue and has a ribbed area at its end.

7. Pull-through security seal according to claim 1 wherein said tongue has cross section that is uniformly rectangular or dumbbell-shaped over its entire length and the surface is smooth.

8. Pull-through security seal according to claim 1 wherein said retaining means has tooth-shaped pointed elements at its ends which, in the marginal area of the pull-through opening, project inward at an acute angle opposite the pull-through direction.

9. Pull-through security seal according to claim 8 wherein the retaining means consist of metal.

10. Pull-through security seal according to claim 1 wherein said groove fits around the entire retaining means.

11. Pull-through security seal according to claim 10 wherein the groove has an opening which is located so that it points into the interior of said housing part.

12. Pull-through security seal according to claim 11 wherein, in the vicinity of the transition between the basic body and the tongue, a single notch is designed as a tear-open strip which runs at an acute angle to the lengthwise axis of the tongue and has a curved area.

13. Pull-through security seal according to claim 10 wherein, in the vicinity of the transition between the basic body and the tongue, a single notch is designed as a tear-open strip which runs at an acute angle to the lengthwise axis of the tongue and has a curved area.

14. Pull-through seal according to claim 13 wherein said tongue has a reinforcing rib in the vicinity of said notch.

15. Pull-through security seal according to claim 10 wherein a retaining tab is formed on said basic body that extends essentially parallel to the tongue and has a ribbed area at its end.

16. Pull-through security seal according to claim 1 wherein, in the vicinity of the transition between the basic body and the tongue, a single notch is designed as a tear-open strip which runs at an acute angle to the lengthwise axis of the tongue and has a curved area.

17. Pull-through seal according to claim 16 wherein said tongue has a reinforcing rib in the vicinity of said notch.

18. Pull-through security seal according to claim 16 wherein the tongue in the vicinity of said tear-open strip is no wider or thicker than the remaining body of the tongue.

19. Pull-through seal according to claim 12 wherein said tongue has a reinforcing rib in the vicinity of said notch.

20. Pull-through security seal according to claim 16 wherein a retaining tab is formed on said basic body that extends essentially parallel to the tongue and has a ribbed area at its end.

* * * * *